United States Patent [19]

Lawrence

[11] Patent Number: 4,644,865

[45] Date of Patent: Feb. 24, 1987

[54] ONE-PIECE CARTRIDGE AND SABOT WITH GAS-ACTUATED CUTTER MEMBER

[75] Inventor: David M. Lawrence, Billerica, Mass.

[73] Assignee: Automation Associates, Inc., Billerica, Mass.

[21] Appl. No.: 736,221

[22] Filed: May 20, 1985

[51] Int. Cl.[4] ..... F42B 5/02

[52] U.S. Cl. ..... 102/430; 102/520

[58] Field of Search ..... 102/430, 441, 464–468, 102/520–523

[56] References Cited

U.S. PATENT DOCUMENTS

| | | | |
|---|---|---|---|
| 3,164,092 | 1/1965 | Reed et al. . | |
| 3,288,066 | 11/1966 | Stadler et al. | 102/520 |
| 3,726,231 | 4/1973 | Kelly et al. . | |
| 3,935,816 | 2/1976 | Boquette, Jr. | 102/466 |

FOREIGN PATENT DOCUMENTS

| | | | |
|---|---|---|---|
| 2032070 | 4/1980 | United Kingdom | 102/521 |

*Primary Examiner*—Harold J. Tudor
*Attorney, Agent, or Firm*—Pearson & Pearson

[57] ABSTRACT

A sabot-type cartridge has a one-piece body of thermoplastic material and a standard body configuration, such as that of a .44 Magnum, with a propellant chamber, primer, and an integral sabot of full caliber. The sabot is generally hollow, cylindrical in configuration, with radially extending ribs, separated by longitudinal grooves, the ribs supporting and centering a sub-caliber projectile, such as a .22 caliber. The annular mouth of the sabot is co-planar with the tip of the projectile to form a tapered funnel-like air inlet. A gas-actuated cutter means, in the form of a normally cupped metal member, is interposed between the projectile and the propellant chamber. There are sharp cutting edges on the multiple lobes of the member to slice the sabot free of the cartridge upon detonation of the propellant. As the sabot exits from the muzzle of the firearm, air pressure expands the sabot, in the manner of a spring collet, and releases the projectile. The invention is intended to, but not limited to, provide a family of sub-caliber cartridges, which may be loaded into, and fired from standard firearms currently manufactured by others.

10 Claims, 12 Drawing Figures

Fig. 1.
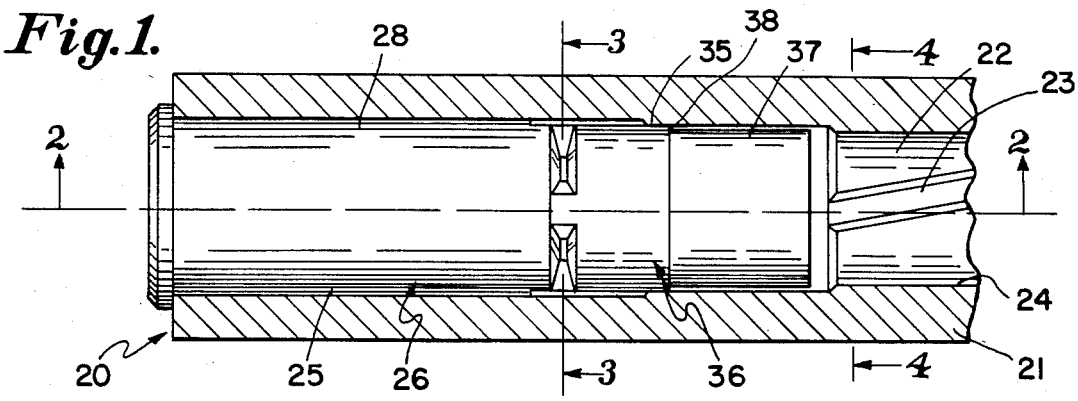
Fig. 2.
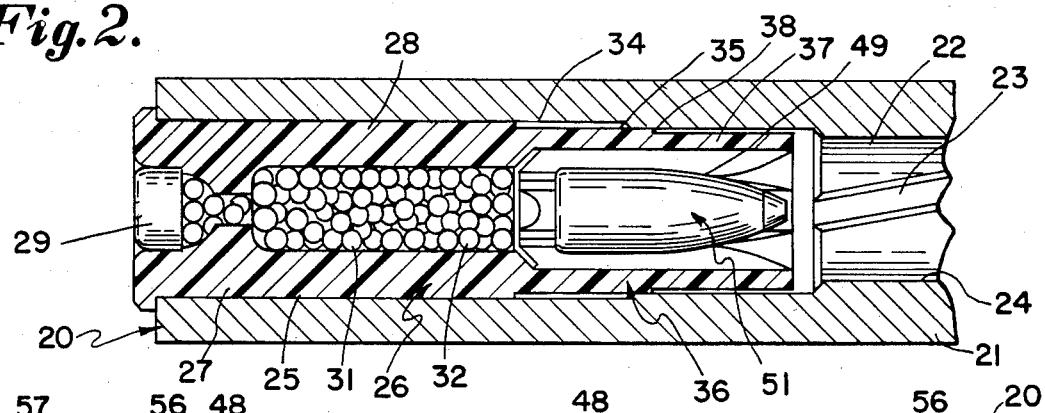
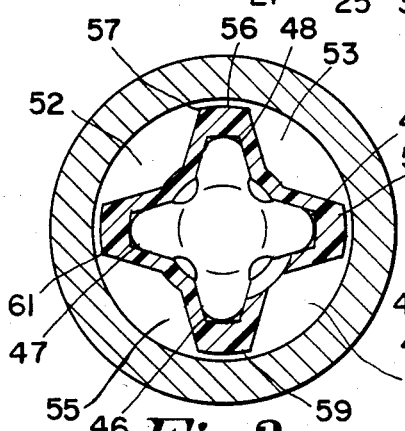
Fig. 3.
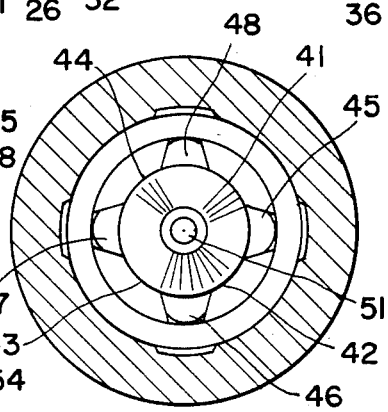
Fig. 4.
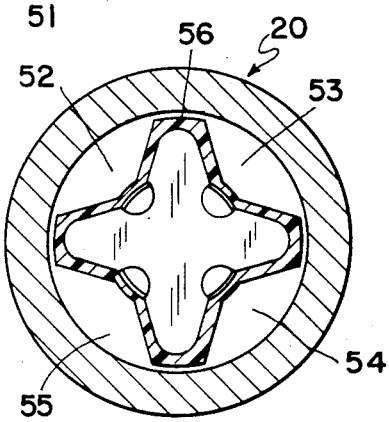
Fig. 5.
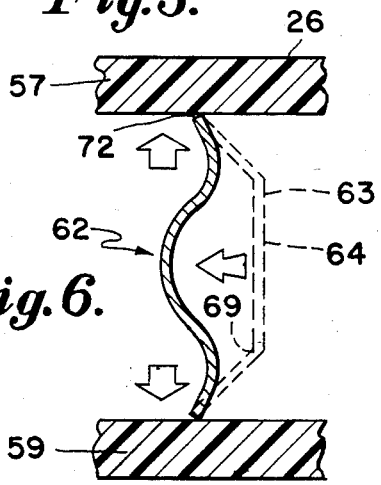
Fig. 6.
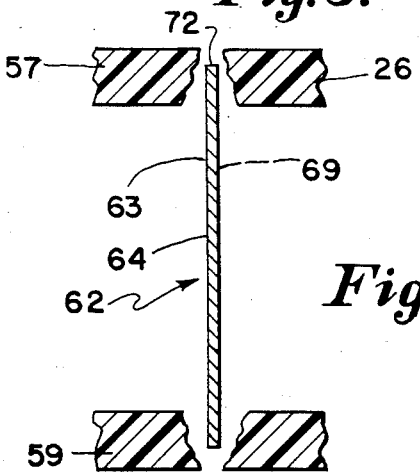
Fig. 7.

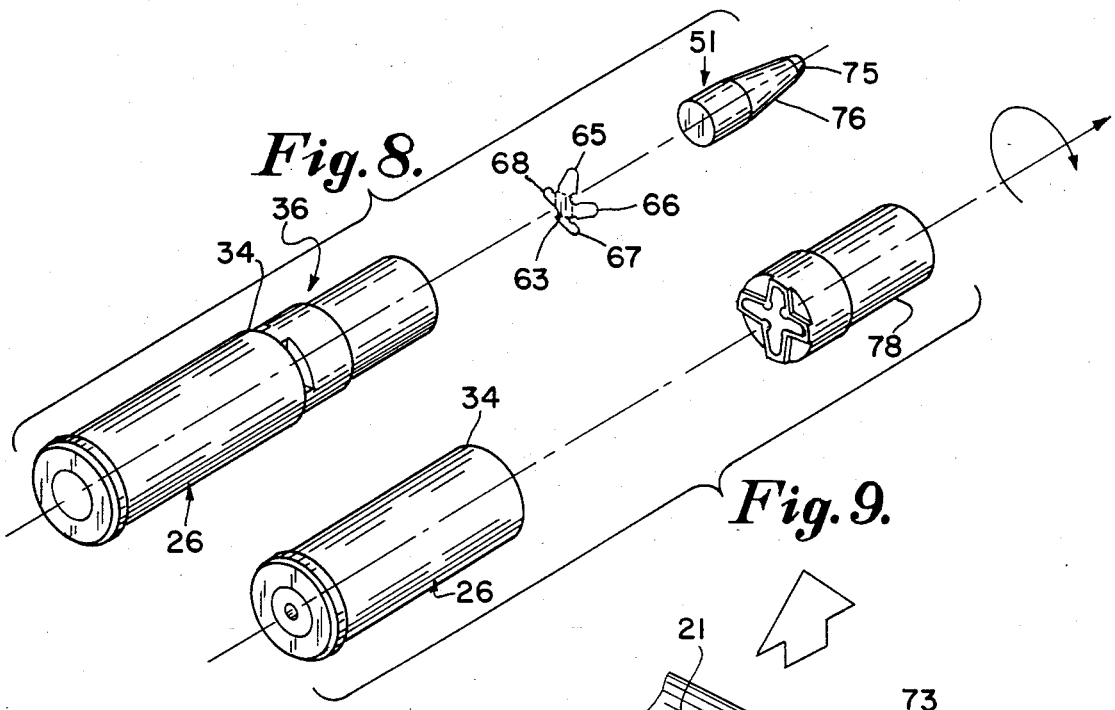
Fig. 8.
Fig. 9.
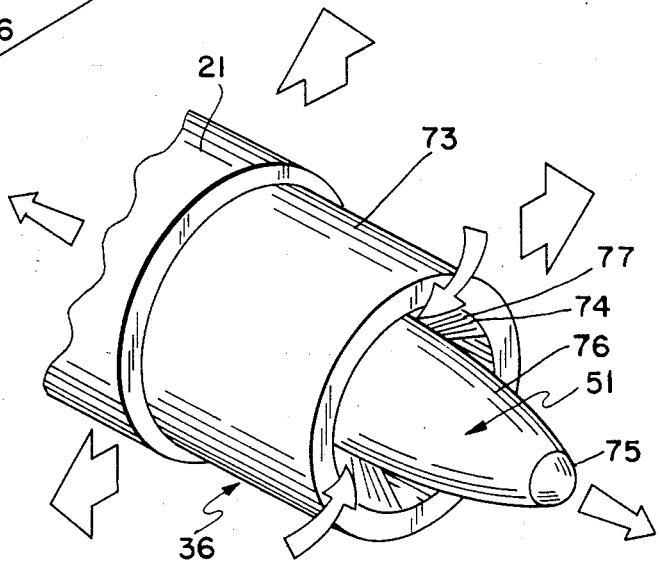
Fig. 12.
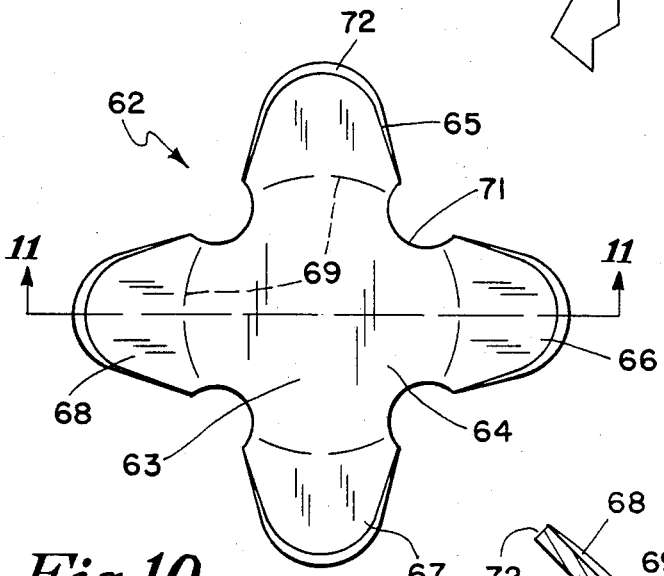
Fig. 10.
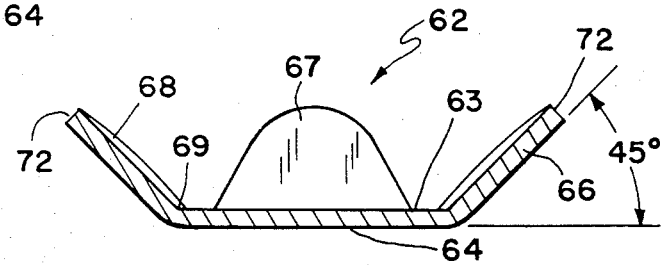
Fig. 11.

ONE-PIECE CARTRIDGE AND SABOT WITH GAS-ACTUATED CUTTER MEMBER

BACKGROUND OF THE INVENTION

It has long been known to provide a sabot, or sleeve, of plastic on a sub-caliber projectile to serve as a carrier for the projectile in the bore of the barrel of a full-caliber weapon. Such combinations of sub-caliber projectile and full-caliber sabot are commonly used in naval or field artillery and tank weapon rounds, similar devices have also been scaled down for use in rifles.

Usually such combinations of projectile and plastic sabot have been fitted into the mouth of a metallic shell, which contains the propellant charge and a means of detonating that propellant.

Exemplary of such plastic sabots are those disclosed in U.S. Pat. No. 3,005,408 to Prossen, et al of Oct. 24, 1961 and U.S. Pat. No. 3,551,972 to Engel of Jan. 5, 1971.

Such combinations may also be inserted into the breech of a weapon ahead of a separate propellant charge as disclosed in U.S. Pat. No. 3,148,472 to Hegge, et al of Sept. 15, 1964.

In U.S. Pat. No. 384,574 to Hawley of June 12, 1888, it was proposed to interpose a spring between the base of a projectile and a series of leather washers, mounted on a rear projection of the projectile, so that the spring would throw off the washers after the projectile was fired.

None of the above patents however, teach a one-piece cartridge which combines the sabot/projectile and the propellant compartment into a single body which is inseparable until detonation of the propellant.

The prior art has also taught the use of lateral and longitudinal grooves on the interior, or exterior surfaces of the sabot to aid in the controlled disintegration of the sabot during, or subsequent to, discharge of the projectile as shown in the above mentioned Prossen U.S. Pat. No. 3,005,408 and Engel U.S. Pat. No. 3,551,972.

Such disintegration of the sabot can lead to serious accuracy problems if a part of the disintegrating sabot should strike the projectile.

Other patents of interest in the sabot field are U.S. Pat. No. 2,669,930 to Darby of Feb. 23, 1954 and U.S. Pat. No. 2,992,612 to Critchfield of July 18, 1961.

SUMMARY OF THE INVENTION

This invention departs from the prior art teachings by providing a combined cartridge and sabot which is of one-piece and molded from an engineering-grade thermoplastic resin. The cartridge includes a main body that, for example, will chambe into a standard .44 Magnum revolver and includes a propellant chamber and a primer pocket all conforming to industry standards for specific firearm chambers. Integrally molded with the main body, but separated therefrom by a connecting section, is a forwardly extending, tubular, sabot of the said thermoplastic resin, having an exterior cylindrical surface of full caliber.

The integral sabot is provided with a plurality of longitudinally extending, radially, inwardly projecting ribs separated by grooves, the interior faces of the ribs outlining an axial bore of sub-caliber which supports and centers a sub-caliber projectile, such as a .22 caliber bullet. The forward portion of the sabot/projectile is provided with a hooded bourrelet to engage the lands of the barrel of the weapon to guide the sabot into and over the rifling, separated by an annular shoulder from a slightly larger diameter rearward portion of the exterior surface of the sabot which engages the grooves of the rifling and imparts a stabilizing spin to the projectile.

A gas-actuated cutter means in the form of a normally cupped member having a flat central portion and a set of lobes bent forwardly from the central portion, each lobe terminating in a sharp outer edge, is interposed between the projectile and the propellant in the propellant chamber of the cartridge, precisely in the plane of the connecting section in the cartridge casing. The member is preferably of hard stainless steel with four lobes, each lobe masking one of the four grooves between the four ribs of the sabot, and the lobes are preferably bent at about 45°.

Upon detonation of the propellant charge, the expanding gases apply explosive pressure to the cupped member, instantly flattening it and driving the cutting edges of the lobes radially outwardly to slice through the supporting members of the connecting section which had heretofore connected the sabot to the cartridge, freeing it to be expelled down the barrel by the expanding gases.

The sabot's annular opening is co-planar with the tip of the ogive portion of the projectile, forming a tapered, funnel-like, air inlet, which spreads the sabot. The still cylindrical sabot falls free of the projectile as a unitary cylinder without danger of breaking up into pieces and the sabot then travels a short trajectory to the ground.

The internal longitudinal grooves of the sabot of this invention are not intended to assist in the disintegration of the sabot after discharge from the weapon as are the grooves in prior patents. Instead, they not only permit the insertion of the gas-actuated, multi-lobed, metal, cutter member but, because of the wide opening, hooded bourrelet extending to the tip of the sub-caliber projectile, the sabot is caused to blossom or expand in the manner of a spring collet. The incoming air traveling along the grooves causes the ribs to release their grip on the projectile so that projectile and sabot follow different trajectories down-range.

BRIEF DESCRIPTION OF THE DRAWINGS

FIG. 1 is a side elevational view of a one-piece plastic cartridge of the invention shown diagrammatically in the barrel of a weapon:

FIG. 2 is a view similar to FIG. 1 in section on line 2—2 of FIG. 1:

FIG. 3 is a cross-section on line 3—3 of FIG. 1, through the plane of action of the cutter means;

FIG. 4 is an end elevational view on line 4—4 of FIG. 1;

FIG. 5 is a cross-section on line 3—3 of FIG. 1, at the instant of detonation, showing the cutter member severing the sabot from the cartridge by flattening under axial gas pressure;

FIG. 6 is a diagrammatic, fragmentary view, in half-section, illustrating the action of the cupped cutter member during detonation;

FIG. 7 is a view similar to FIG. 6 illustrating the flattened configuration of the cutter member after detonation as it separates the sabot from the cartridge;

FIG. 8 is an exploded view of the one-piece plastic cartridge of the invention which has already been primed and charged with propellant;

FIG. 9 is a perspective, diagrammatic view of the cartridge an instant after detonation, showing the four support members connecting the sabot to the cartridge severed by the flattened cutter member;

FIG. 10 is a front elevation; and

FIG. 11 is a side elevation on an enlarged scale of the lobed, cutter member of the invention in normal cupped configuration, FIG. 11 being in section on line 11—11 of FIG. 10; and FIG. 12 is a diagrammatic view, on an enlarged scale showing the hooded plastic sabot acting as a funnel-like air inlet port and expanding radially to release the projectile after emerging from the barrel of the weapon.

DESCRIPTION OF THE PREFERRED EMBODIMENT

As shown in FIGS. 1 and 2, a typical weapon 20, which may be a hand-held firearm of the revolver type, such as a ".357 Magnum", or a ".44 Remington Magnum" includes a barrel 21 with internal lands 22, and grooves 23, forming an axial bore 24, all of well known construction. The weapon 20 also includes a cartridge chamber 25 and the usual firing pin, trigger mechanism, sights, etc. not shown and well known.

Unlike the conventional independent metal cartridge case and projectile, or independent cartridge case, sabot and sub-caliber projectile of the prior art, in this invention, a one-piece cartridge 26 is provided, preferably made of thermoplastic resin 27, and having a main body, or chamber portion 28 armed with a primer 29, and a propellant 31 in a propellant chamber 32.

The one-piece, thermoplastic cartridge 26 is sized on the exterior of the chamber portion 28, to slide-fit into the chamber 25 of the weapon 20. The diameter is then reduced to equal the full caliber of the weapon in the elongated, exterior, engagement portion 35 of the integral, elongated sabot 36, also of thermoplastic material 27. The shoulder 34 is thus in front of the main body 28.

The sabot 36 is provided with a hooded bourrelet 37 which guides it into and over the lands of the barrel. The engagement portion 35 is provided with a leading edge 38, located at, or slightly aft of, the center of gravity of the sabot/projectile combination.

The elongated, tubular sabot 36 is thus of full-caliber such as the ".44 Magnum" mentioned above, in the engagement portion 35, and of slightly less diameter in the hooded bourrelet 37, the location of the leading edge 38, and the support of the bourrelet, preventing the balloting or nutation of the sabot portion of the cartridge as it travels down the barrel 21.

The sabot 36 is provided with a plurality of alternate ribs and grooves extending longitudinally thereof, there preferably being four, radially, inwardly projecting ribs 41, 42, 43 and 44, equally spaced apart by four grooves 45, 46, 47 and 48 (FIG. 4) as shown. The ribs 41, 42, 43, and 44 outline an axial bore 49 of sub-caliber which supports and centers a projectile 51 of sub-caliber such as a .22 caliber bullet sleeved in the sabot 36.

The one-piece plastic cartridge 26 preferably is molded, or otherwise formed, with four recesses 52, 53, 54, and 55, equally spaced around the face 56 of the engagement portion 35, by supporting members, and thin connecting webs, 57, 58, 59 and 61 at the shoulder 34. Each thin-walled web is outside one of the four grooves 45, 46, 47 and 48 as shown (FIG. 3).

Gas-actuated cutter means 62 is provided in this invention between the propellant 31, in propellant chamber 32, and the sabot 36, the cutter means being in the form of a normally cupped cutter member 63, preferably of thin, hard, stainless steel. Cutter member 63 is of one piece of metal having a flat, central portion 64 outlining a circle, and multiple lobes, such as four, one for each groove 45, 46, 47 and 48 in the sabot. The lobes 65, 66, 67, and 68 are spaced apart from each other and normally bent forwardly along a fold line such as 69, at an angle of 45° forwardly from the portion 64 (FIGS. 10 and 11).

Preferably, there is a cut-out, such as 71, at the fold line 69, between each adjacent pair of lobes, to assist in the accurate, full flattening of the cup shaped member 63 under the pressure of gas from the propellant during detonation. The outer edges, such as 72, of each lobe 65, 66, 67 and 68, are sharp so that as gas pressure of detonation instantly changes the configuration of the cutter member 63 from its normal cupped shape to a flattened configuration, as illustrated in FIGS. 6 and 7, the sharp edges 72 of the lobes slice through the support members 57, 58, 59, and 61, connecting the plastic sabot to the plastic cartridge, freeing the sabot to travel down the full caliber barrel 21 with the sub-caliber projectile 51 supported and centered therewithin.

It will be noted that each lobe 65, 66, 67 and 68 of the cutter member 63 masks one of the grooves 45, 46, 47 or 48 of the sabot 36 when in its normal cupped configuration, seated at the rearward end of the grooves 45, 46, 47, and 48 of the sabot directly aligned with the center of the spaced recesses 52, 53, 54 and 55, and supporting members 57, 58, 59 and 61. (The plane of section line 3—3)

The one-piece plastic cartridge 26 and sabot 36 includes the elongated, integral hooded bourrelet 73 which terminates in an annular opening 74 co-planar with the terminal tip 75 of the ogive 76, of the projectile 51. Thus, a tapered, open, funnel-like air inlet port 77 is formed between the sabot and projectile ogive 76. As they travel down the barrel 21, and are discharged down-range, (FIG. 12), the incoming air enters the grooves between the ribs of the sabot 36 and expands it sufficiently to cause it to release its grip on the projectile. The sabot slides from the projectile as a one-piece cylinder 78 with no dissolution of parts likely to interfere with the trajectory of the sub-caliber projectile. The one-piece cylindrical unitary sabot travels more slowly than the projectile and simply falls to the ground proximate the firearm from which it was discharged.

The multiple lobed cutter member 63 is punched, or chemically etched from a pre-tempered, spring-hard metal stock, with the four lobes each formed slightly wider than the opening of the groove with which it mates, but after lobes are formed at a 45° angle, the sides of the lobes fit grooves of the sabot, with only the tips of the lobes contacting the grooves. The cutter is forced into the plastic cartridge and seated at the bottom of the grooves in a pre-loaded condition, with its lobes impinging against the molded plastic support members 57, 58, 59, and 61, which keep the sabot portion and the chamber portion of the cartridge in axial alignment during storage and handling. The projectile 51 is press fitted into the ribs 41, 42, 43 and 44 of the sabot 36.

The thin flexible cupped metallic cutter member 63, as shown diagrammatically in FIGS. 6 and 7 is flexed forwardly by the pressure of the expanding gas of detonation of the propellant. Energy is stored for an instant in the lobes by the buckling compression of each lobe. This energy is released as an outward force causing the sharp edges of the lobes to sever the supporting members connecting the sabot to the cartridge and freeing the sabot to travel down the barrel.

I claim:

1. In combination:

a cartridge of plastic material having a main body of cylindrical configuration, said main body containing a propellant chamber and a primer pocket;

a tubular sabot, of said plastic material, integral with said main body, and of full caliber;

said sabot having a plurality of spaced, elongated, alternate ribs and grooves extending radially inwardly and outlining an axial bore of sub-caliber;

a projectile of said sub-caliber sleeved within said sabot for discharge therewith upon detonation of said propellant in said chamber;

and cutter means interposed between said projectile and said propellant in said chamber for expanding laterally to slice said sabot in one piece from said cartridge, under detonation gas pressure during ejection of said projectile.

2. A combination as specified in claim 1 wherein:

said cutter means is of thin sheet metal, normally of cupped configuration, but adapted to flatten to substantially disk configuration under axial pressure to slice said plastic material outwardly and radially to separate said sabot from said cartridge.

3. A combination as specified in claim 1 wherein:

said cutter means is a normally cupped, thin metal, multiple lobed, member, with one lobe for each groove in said sabot, each said lobe being positioned to mask one of said grooves against the pressure of said detonation thereby causing said cupped member to flatten and slice said sabot from said cartridge.

4. A combination as specified in claim 1 wherein:

said cutter means is a normally cupped, multiple-lobed, hard stainless steel member, each lobe adapted to mask one of the longitudinal grooves in said sabot and each lobe bent forwardly at an angle of 45°, from a fold line at its base, said fold lines outlining a circle and there being a cut-out in said metal, into said circle, between each pair of adjacent lobes, to assist in flattening said lobes under pressure of detonation to slice said sabot free of said cartridge.

5. In combination:

a gun barrel having a longitudinal bore therethrough of full caliber for the passage of expanding gases generated upon the firing of a cartridge therein;

a cartridge of plastic material, having a main body containing a propellant in a propellant chamber backed by a primer and having an integral sabot of full caliber, separated by an annular exterior shoulder in front of said main body, said sabot having internal, longitudinal, alternate ribs and grooves;

a sub-caliber projectile, supported in, and centered by, the said ribs of said sabot and;

a thin sheet metal cutter member interposed between said projectile and the propellant in said propellant chamber, said member having a flat central portion and a plurality of spaced, separate lobes bent forwardly from said central portion, each lobe masking one of said grooves, each lobe having an outer sharp edge for slicing said sabot free of said cartridge when said member is flattened by the force of detonation of said propellant;

whereby said sabot is ejected from said barrel bore in one cylindrical piece traveling more slowly than said projectile after having released said projectile.

6. A combination as specified in claim 5 wherein:

each sabot has four ribs and four grooves and each member has four lobes.

7. A combination as specified in claim 5 wherein:

said sabot is positioned within said cartridge with the outer sharp edges of the forwardly bent lobes thereof substantially in the diametrical plane of the connecting section of said cartridge.

8. A combination as specified in claim 5 wherein:

said sabot has a supporting member at said connecting section interrupted by a spaced set of radial recesses, and each said lobe is of sufficient length and is so located as to pierce the said supporting member between an adjacent pair of said recesses so that it will slice through the said supporting member when said cutter member is flattened by detonation of the propellant in said propellant chamber.

9. A cartridge of plastic material having a propellant chamber in the rearward portion and an integral sabot in the forward portion;

said sabot being of said plastic material, being of full caliber and having a sub-caliber projectile therewithin;

and gas-actuated cutter means interposed between said projectile and said propellant chamber for separating said sabot from said cartridge under the pressure of detonation of propellant in said propellant chamber;

said gas-actuated cutter means is normally a generally cupped metallic, thin member, with sharp outer edges, said member adapted to flatten under axial pressure, to disk configuration to cause said sharp edges to cut said sabot free in one piece from said cartridge.

10. A cartridge as specified in claim 9 wherein:

said sabot is of generally cylindrical, tubular, configuration with interior, radially extending, alternate ribs and grooves supporting and centering said projectile and said projectile includes an ogive with a terminal tip;

said sabot having a hooded bourrelet with an open annular mouth in the plane of the tip of said projectile and forming a funnel-like air inlet port for the controlled expansion of said sabot during advance of said sabot and projectile to release said projectile from said sabot.

* * * * *